US009765620B2

(12) United States Patent
Lehnert et al.

(10) Patent No.: US 9,765,620 B2
(45) **Date of Patent: *Sep. 19, 2017**

(54) CHISEL HOLDER

(71) Applicant: Wirtgen GmbH, Windhagen (DE)

(72) Inventors: Thomas Lehnert, Oberraden (DE); Karsten Buhr, Willroth (DE); Martin Lenz, Grossmaischeid (DE); Cyrus Barimani, Königswinter (DE); Günter Hähn, Königswinter (DE); Karl Kammerer, Fluorn-Winzeln (DE); Markus Roth, Aichhalden (DE); Bernhard Diessner, Telfes in Stubai (AT)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/976,861

(22) Filed: Dec. 21, 2015

(65) Prior Publication Data

US 2016/0177717 A1 Jun. 23, 2016

Related U.S. Application Data

(63) Continuation of application No. 13/822,720, filed as application No. PCT/EP2011/071587 on Dec. 2, 2011, now Pat. No. 9,228,434.

(30) Foreign Application Priority Data

Dec. 3, 2010 (DE) ..... 10 2010 061 019
Jul. 4, 2011 (DE) ..... 10 2011 051 523

(51) Int. Cl.
*E21C 35/18* (2006.01)
*E21C 35/193* (2006.01)
(Continued)

(52) U.S. Cl.
CPC ..... *E21C 35/193* (2013.01); *E01C 23/088* (2013.01); *E21C 35/18* (2013.01); *E21C 35/197* (2013.01); *E21C 35/1933* (2013.01)

(58) Field of Classification Search
CPC ..... E21C 35/18; E21C 35/191
See application file for complete search history.

(56) References Cited

U.S. PATENT DOCUMENTS 2,452,081 A 10/1948 Sullinger
3,143,177 A 8/1964 Galomeau et al.
(Continued)

FOREIGN PATENT DOCUMENTS

CA 2742849 A1 5/2010
CN 1942655 A 4/2007
(Continued)

OTHER PUBLICATIONS

U.S. Appl. No. 13/822,720, filed Mar. 13, 2013 to Lehnert et al. (not prior art).
(Continued)

*Primary Examiner* — John Kreck
(74) *Attorney, Agent, or Firm* — Lucian Wayne Beavers; Patterson Intellectual Property Law, PC

(57) ABSTRACT

The subject matter of the invention is a bit holder for an earth working machine, in particular a road milling machine, having a support member onto which an insertion projection is indirectly or directly attached on an insertion projection side, the insertion projection comprising at least one convex abutment surface and one pressure surface. In a bit holder of this kind, working forces can be dissipated in stress-optimized fashion into an attached base part when provision is made that the insertion projection comprises two convex abutment surfaces that are arranged at a distance from one another.

18 Claims, 8 Drawing Sheets

(51) Int. Cl.
*E21C 35/197* (2006.01)
*E01C 23/088* (2006.01)

(56) References Cited

U.S. PATENT DOCUMENTS

| | | | |
|---|---|---|---|
| 3,498,677 | A | 3/1970 | Morrow |
| 3,992,061 | A | 11/1976 | Rollins |
| 4,180,292 | A | 12/1979 | Persson |
| 4,240,669 | A | 12/1980 | Rollins |
| 4,275,929 | A | 6/1981 | Krekeler |
| 4,302,055 | A | 11/1981 | Persson |
| 4,415,208 | A | 11/1983 | Goyarts |
| 4,542,943 | A | 9/1985 | Montgomery, Jr. |
| 4,650,256 | A | 3/1987 | Wetzinger |
| 4,693,518 | A | 9/1987 | Sulosky et al. |
| 4,828,327 | A | 5/1989 | Wechner |
| 4,915,455 | A | 4/1990 | O'Neill et al. |
| 5,011,229 | A | 4/1991 | O'Neill et al. |
| 5,186,575 | A | 2/1993 | Wirtgen |
| 5,322,351 | A | 6/1994 | Lent |
| 5,378,050 | A | 1/1995 | Kammerer et al. |
| 5,529,384 | A | 6/1996 | Ojanen et al. |
| 5,573,308 | A | 11/1996 | Simons et al. |
| 5,683,144 | A | 11/1997 | Kammerer et al. |
| 6,234,579 | B1 | 5/2001 | Montgomery, Jr. |
| 6,244,665 | B1 | 6/2001 | Bise et al. |
| 6,619,756 | B1 | 9/2003 | Holl et al. |
| 6,619,757 | B1 | 9/2003 | Kammerer |
| 6,644,755 | B1 | 11/2003 | Kammerer |
| 6,685,273 | B1 | 2/2004 | Sollami |
| 6,712,431 | B1 | 3/2004 | Bosch et al. |
| 6,764,140 | B2 | 7/2004 | Carson, Jr. et al. |
| 6,779,850 | B1 | 8/2004 | Schibeci et al. |
| 6,854,810 | B2 | 2/2005 | Montgomery, Jr. |
| 6,866,343 | B2 | 3/2005 | Holl et al. |
| 7,086,704 | B2 | 8/2006 | Holl et al. |
| 7,300,115 | B2 | 11/2007 | Holl et al. |
| D567,270 | S | 4/2008 | Chiang |
| D574,689 | S | 8/2008 | Holl et al. |
| D575,610 | S | 8/2008 | Holl et al. |
| 7,461,903 | B2 | 12/2008 | Tewes et al. |
| D585,259 | S | 1/2009 | Holl et al. |
| 7,475,949 | B2 | 1/2009 | Helsel et al. |
| 7,537,288 | B2 | 5/2009 | Chiang |
| 7,547,075 | B2 | 6/2009 | Tewes et al. |
| 7,597,402 | B2 | 10/2009 | Tewes et al. |
| 7,744,164 | B2 | 6/2010 | Hall et al. |
| 7,784,875 | B2 | 8/2010 | Holl et al. |
| 7,922,256 | B2 | 4/2011 | Kammerer et al. |
| 7,922,257 | B2 | 4/2011 | Kammerer |
| D638,453 | S | 5/2011 | Buhr et al. |
| 8,061,783 | B2 | 11/2011 | Keller et al. |
| D657,648 | S | 4/2012 | Wachsmann |
| D666,226 | S | 8/2012 | Buhr et al. |
| D666,641 | S | 9/2012 | Buhr et al. |
| D666,642 | S | 9/2012 | Buhr et al. |
| D666,643 | S | 9/2012 | Buhr et al. |
| D667,854 | S | 9/2012 | Kammerer et al. |
| D667,855 | S | 9/2012 | Kammerer et al. |
| D667,856 | S | 9/2012 | Kammerer et al. |
| D671,578 | S | 11/2012 | Buhr et al. |
| D692,037 | S | 10/2013 | Buhr et al. |
| D692,038 | S | 10/2013 | Buhr et al. |
| D692,039 | S | 10/2013 | Buhr et al. |
| D692,040 | S | 10/2013 | Buhr et al. |
| 8,622,484 | B2 | 1/2014 | Charlton |
| 8,746,807 | B2 | 6/2014 | Lehnert et al. |
| 9,151,157 | B2 * | 10/2015 | Lehnert et al. ..... E21C 35/18 |
| 9,228,434 | B2 * | 1/2016 | Lehnert et al. ..... E21C 35/18 |
| 2002/0074850 | A1 | 6/2002 | Montgomery, Jr. |
| 2004/0051370 | A1 | 3/2004 | Montgomery et al. |
| 2006/0119165 | A1 | 6/2006 | Holl et al. |
| 2008/0093912 | A1 | 4/2008 | Willoughby |
| 2009/0085396 | A1 | 4/2009 | Chiang |
| 2009/0160238 | A1 | 6/2009 | Hall et al. |
| 2009/0289493 | A1 | 11/2009 | Holl et al. |
| 2009/0293249 | A1 | 12/2009 | Lehnert et al. |
| 2010/0045094 | A1 | 2/2010 | Sollami |
| 2010/0076697 | A1 | 3/2010 | Wagner et al. |
| 2011/0006588 | A1 | 1/2011 | Monyak et al. |
| 2011/0148178 | A1 | 6/2011 | Lehnert et al. |
| 2011/0148179 | A1 | 6/2011 | Lehnert et al. |
| 2011/0266860 | A1 | 11/2011 | Charlton |
| 2013/0241264 | A1 | 9/2013 | Lehnert et al. |
| 2013/0241265 | A1 | 9/2013 | Lehnert et al. |

FOREIGN PATENT DOCUMENTS

| | | | |
|---|---|---|---|
| CN | 101018927 | A | 8/2007 |
| CN | 101091037 | A | 12/2007 |
| CN | 101175895 | A | 5/2008 |
| CN | 202595605 | U | 12/2012 |
| CN | 202788849 | U | 3/2013 |
| DE | 2940288 | A1 | 5/1980 |
| DE | 3411602 | A1 | 10/1985 |
| DE | 4322401 | A1 | 1/1995 |
| DE | 29822369 | U1 | 3/1999 |
| DE | 19908656 | C1 | 8/2000 |
| DE | 10161009 | A1 | 11/2002 |
| DE | 202005001311 | U1 | 3/2005 |
| DE | 102005010678 | A1 | 9/2006 |
| DE | 102005017760 | A1 | 10/2006 |
| DE | 102005055544 | A1 | 5/2007 |
| DE | 202007013350 | U1 | 3/2008 |
| DE | 102004030691 | B4 | 12/2008 |
| DE | 10261646 | B4 | 2/2010 |
| DE | 202009014077 | U1 | 4/2010 |
| DE | 102009059189 | A1 | 6/2011 |
| EM | 001848938 | | 4/2011 |
| EP | 0706606 | B1 | 3/1997 |
| EP | 0771911 | A1 | 5/1997 |
| EP | 0997610 | A1 | 5/2000 |
| JP | 4527043 | | 10/1970 |
| JP | 2008503669 | A | 2/2008 |
| KR | 1020050091022 | B1 | 9/2005 |
| TW | 407538 | U | 10/2000 |
| TW | I265836 | B | 11/2006 |
| TW | M326448 | U | 2/2008 |
| TW | M364551 | U1 | 9/2009 |
| TW | M378059 | U | 4/2010 |
| WO | 2006056269 | A1 | 6/2006 |
| WO | 2006119536 | A1 | 11/2006 |
| WO | 2010051593 | A1 | 5/2010 |
| WO | 2011004030 | A2 | 1/2011 |

OTHER PUBLICATIONS

U.S. Appl. No. 13/822,917, filed Mar. 13, 2013 to Lehnert et al. (not prior art).

U.S. Appl. No. 13/989,837, filed Dec. 2, 2011 to Kammerer et al. (not prior art).

DE 102010061019.4 "Examination Report" Oct. 20, 2011, 4 pp. (not prior art).

EP 11172525.5 "European Search Report" Dec. 8, 2011, 5 pp. (not prior art).

EP 11172527.1 "European Search Report" Dec. 8, 2011, 5 pp. (not prior art).

English translation of Notification for the Opinion of Examination with translated of the search report, Taiwanese Application No. 100144345, mailing date Dec. 6, 2013, 4 pp. (not prior art).

First Examination Report with English translation, Chinese Patent Application No. 201110395057.2, Applicant: Wirtgen GmbH, Mailing Date: Jan. 30, 2014, 11 pp. (not prior art).

First Examination Report with English translation, Chinese Patent Application No. 201110394632.7, Applicant: Wirtgen GmbH, Mailing Date: Jan. 28, 2014, 19 pp. (not prior art).

Office Action of Dec. 16, 2014 in co-pending U.S. Appl. No. 13/991,297. (not prior art).

English translation of Notification for the Opinion of Examination issued for Taiwanese Application No. 100144345, mailed on Aug. 18, 2014, 3 pages. (not prior art).

(56) References Cited

OTHER PUBLICATIONS

Written Opinion issued for Singapore parallel patent application 2013041637 mailed on Jun. 27, 2014, 13 pages. (not prior art).
Written Opinion and Search Report issued for Singapore application No. 2013042320, dated on Jun. 5, 2014, 19 pages. (not prior art).
First Office Action dated Jan. 28, 2014, in related Chinese patent application No. 201110394632.7, with English translation, 19 pages. (not prior art).
English Translation of Notification for the opinion of Examination and search report from Taiwanese Patent Office mailed May 9, 2014, for related Taiwanese application No. 100144342, 6 pages. (not prior art).
Notification of the First Office Action with English translation, Chinese Patent Application No. 201110395057.2, Applicant: Wirtgen GmbH, Mailing Date: Jan. 30, 2014, 11 pages. (not prior art).
U.S. Appl. No. 14/863,522, filed Sep. 24, 2015. (not prior art).

* cited by examiner

CHISEL HOLDER

The invention relates to a bit holder for an earth working machine, in particular a road milling machine, having a support member onto which an insertion projection is indirectly or directly attached on an insertion projection side, the insertion projection comprising at least one convex abutment surface and one pressure surface.

A bit holder of this kind is known from EP 0 771 911 A1, in which the bit holder comprises an insertion projection having a frustoconical external geometry. The bit holder can be inserted, with the insertion projection, into a base part that is fastened on the surface of a tubular milling drum. A compression screw that acts on the insertion projection is used to immobilize the bit holder. The insertion projection is secured with the compression screw in a receiving bore of a bit holder. During operational utilization, large working forces are dissipated via the bit holder into the base part. The round shank cross section of the insertion projection prevents forces from being transferred in a circumferential direction of the insertion projection.

Large alternating loads are, however, introduced into a working tool held in the bit holder, and transferred into the base part. These alternating stresses load the mating surfaces between the bit holder and base part. Especially when milling very hard substrate coverings, such as e.g. concrete surfaces, it may happen that the seating surfaces between the bit holder and base part become spread apart or deflected. Secure retention of the bit holder in the base part is then no longer guaranteed. In particular, the base part must then be replaced, which is associated with a large outlay in terms of parts and installation.

Bit holders that make possible a certain resetting of the bit holder in the base part even in the event of wear are therefore used in order thereby to achieve a long service life.

A bit holder of this kind is presented in DE 43 22 401 A1. Here a pentagonal insertion projection is inserted into a correspondingly configured insertion receptacle of a base part.

The bit holder is braced with a support surface of its supporting member against a counter-surface of the base part, so that a large portion of the stresses can thereby be dissipated. With the pentagonal cross section of the insertion projection, transverse forces occurring during working are introduced via the insertion projection into the base part. In addition to the desired tensile stresses and the unavoidable flexural stresses, however, torsional stresses also occur in the insertion projection. A multi-axis stress situation thus exists.

The object of the invention is to create a bit holder of the kind mentioned previously, with which the working forces during working utilization can be dissipated in stress-optimized fashion into a base part.

This object is achieved in that the insertion projection comprises two convex abutment surfaces that are arranged at a distance from one another. The use of two convex abutment surfaces creates two abutment regions that ensure reliable bracing. In addition, the two abutment surfaces make it possible to implement a statically determined stress system.

Even if surface wear occurs, the two abutment surfaces can reset against the corresponding counter-surfaces of the base part so that the bit holder can be re-clamped. In addition, replacement of a worn bit holder in an existing base part is then also possible.

According to a preferred embodiment of the invention, provision can be made that the abutment surfaces are arranged at a distance from one another by means of a recess of the insertion projection. This recess is easy to manufacture in terms of production engineering, so that the bit holder can be produced with little outlay.

The abutment surfaces preferably have the same radius of curvature or the same curvature geometry, thereby enabling a simple geometry for the counter-surfaces of the base part into which the insertion projection is inserted.

Particularly preferably, the two abutment surfaces are arranged symmetrically with respect to the longitudinal center axis of the insertion projection, thereby making possible symmetrical force dissipation.

Particularly preferably, the abutment surfaces are located on an identical reference circle. Provision can further be made that the abutment surfaces have the same curvature center point, so that production is further simplified. For example, the abutment surfaces can be surface-turned or otherwise machined in one clamping.

It has been found that the radius of curvature of the abutment surfaces should be in the range between 16 mm and 32 mm. With smaller radii of curvature there is a risk of excessive surface wear under large loads. If the radius of curvature that is selected is too large, reliable securing of the insertion projection against the pressure surface can become problematic. It is particularly advantageous if the radius is a constant radius over the length of the abutment surfaces, resulting in a partly-cylindrical geometry of the abutment surfaces. This feature makes possible simple configuration of the insertion receptacle of a base part into which the insertion projection is inserted.

It has been found that for the required application instances in earth working machines, the dimension of the abutment surfaces in the direction of the insertion projection should be in the range between 20 mm and 50 mm. The clamping forces are then transferred from the bit holder to the base part in a manner optimized in terms of surface pressure. The dimension of the abutment surfaces in the circumferential direction should then be respectively in the range between 30° and 80°.

A bit holder according to the present invention can be such that the abutment surfaces transition via a convex transition region into the at least locally concavely embodied recess. A stress-optimized insertion projection cross section is thereby configured.

A bit holder according to the invention can be characterized in that the abutment surfaces are arranged at least locally in the region of the insertion projection front side facing in the tool advance direction, and the pressure surface is arranged in the region of the insertion projection back side.

In order to obtain a symmetrical force distribution, provision can be made that the abutment surfaces are arranged symmetrically with respect to the central transverse plane of the insertion projection extending in the direction of the longitudinal center axis of the insertion projection, and/or that the pressure surface is arranged symmetrically with respect to said central transverse plane. With the symmetrical arrangement of the abutment surfaces and the pressure surface, as well as the division of the abutment surface into a pair of distanced sub-surfaces, the reaction force to the contact pressure force that is introduced via the pressure surface is divided into a pair of forces, the vectors of the reaction force pair forming, with the vector of the contact pressure force, a system in which the vectors run toward one another in a star shape and meet at the center of the insertion projection.

To allow sufficient draw-in force to be exerted on the insertion projection via the pressure surface, provision can be made that the pressure surface is arranged at a distance of at least 20 mm (distance dimension A) from the attachment region of the insertion projection onto the support member. It is also conceivable for this purpose for the abutment surfaces to be arranged at a distance of at least 15 mm (distance dimension B) from the attachment region of the insertion projection on the support member.

Provision can also be made in the context of the invention that the surface centroid of at least one of the abutment surfaces is distant no more than 20 mm (distance dimension C), in the direction of the longitudinal center axis of the insertion projection, from the surface centroid of the pressure surface. Sufficiently large clamping forces can then be generated. This also creates a force relationship that enables smooth "sliding" between the insertion projection and base part, in which context the radial components of the clamping force are also absorbed via the abutment surfaces.

If provision is made that the abutment surfaces are formed by carrying segments that are elevated as compared with the actual insertion projection, then on the one hand a defined abutment geometry is created in the transition region to the base part. On the other hand, the abutment surfaces can then wear away on the carrying segments, while the defined abutment geometry is nevertheless maintained. Production is moreover also thereby simplified.

In order to generate a sufficiently large draw-in force in the direction of the longitudinal center axis of the insertion projection, and at the same time a clamping force acting perpendicular to the longitudinal center axis, provision is made according to the present invention that the line normal to the pressure surface is at an angle of between 30° and 70° to the longitudinal center axis of the insertion projection.

The invention will be further explained below with reference to an exemplifying embodiment depicted in the drawings, in which.

Figure 1:
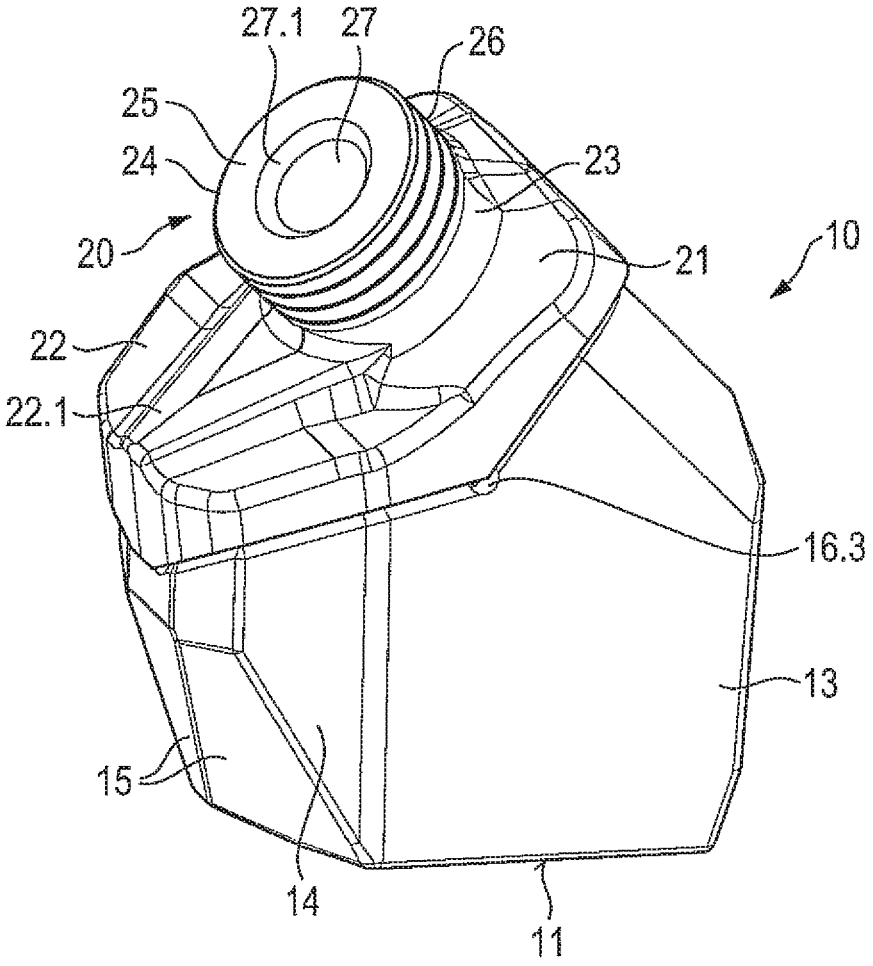
FIG. 1 is a perspective side view of a combination of a base part and a bit holder.

FIG. 1 shows a tool combination made up of a base part 10 and a bit holder 20. Bit holder 20 is connected replaceably to base part 10. Base part 10 comprises a solid basic member 13 that comprises a lower attachment side 11. This attachment side 11 is concavely curved, the curvature being selected in accordance with the outside diameter of a tubular milling drum. Base part 10 can thus be placed with its attachment side 11 onto the outer side of the tubular milling drum and welded in place onto it. Basic member 13 comprises on the front side a projection that is demarcated laterally by oblique surfaces 14 and at the front side by inclined surfaces 15. Inclined surfaces 15 are incident at an angle to one another, and oblique surfaces 14 adjoin inclined surfaces 15 at an angle. This results in an arrow-shaped geometry of base part 10 at the front, leading to better clearing action by base part 10.

Figure 2:
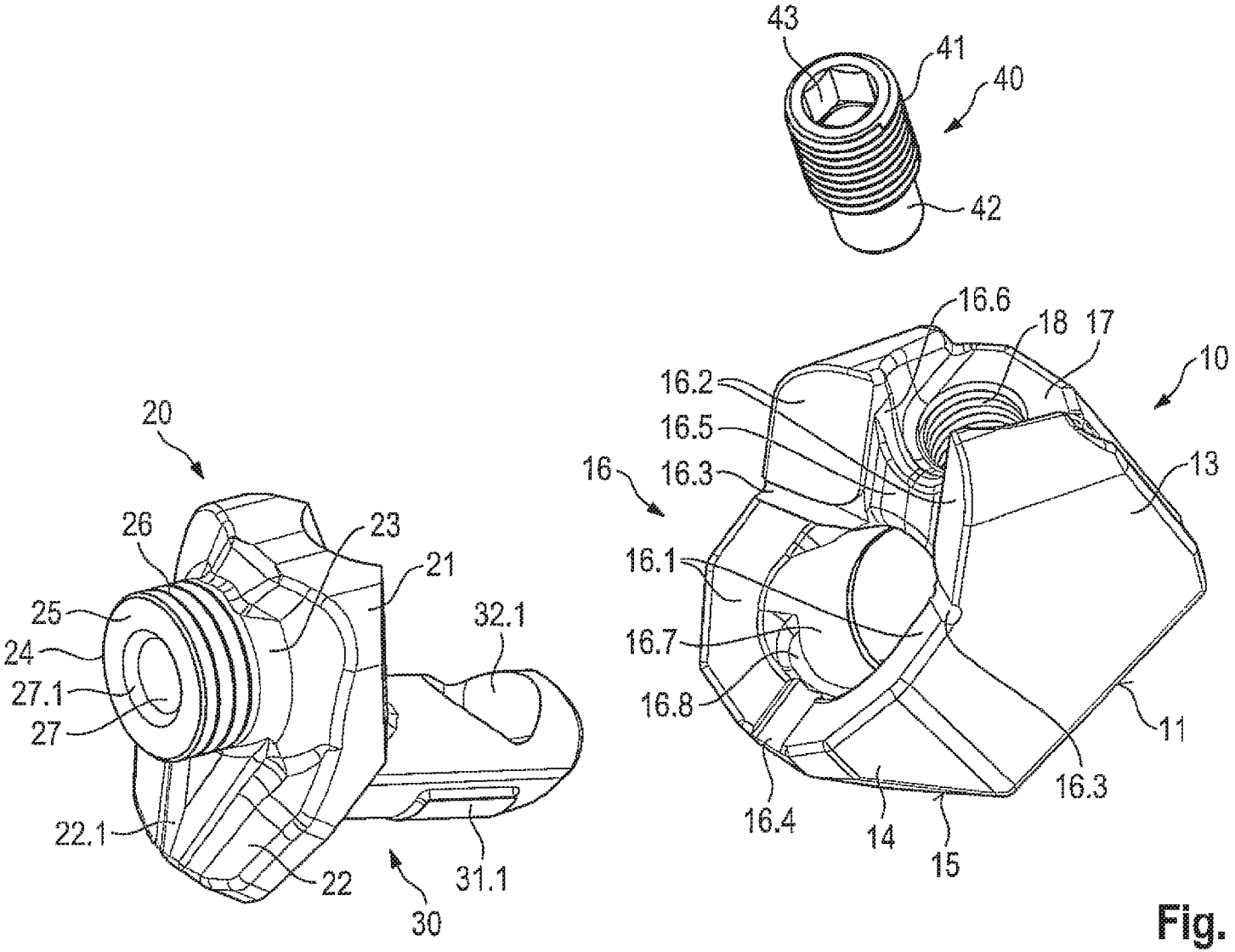
FIG. 2 is an exploded view of what is depicted in FIG. 1.

As FIG. 2 illustrates, a bit holder receptacle 16 having an insertion receptacle 16.7 is recessed into base part 10. Insertion receptacle 16.7 penetrates entirely through basic member 13, and thus opens into attachment side 11. A threaded receptacle 18 that opens into insertion receptacle 16.7 (see FIG. 12) is recessed into base part 10. Bit holder receptacle 16 comprises first support surfaces 16.1 and second support surfaces 16.2. First support surfaces 16.1 form a first support surface pair, and second support surfaces 16.2 form a second support surface pair. In each support surface pair, the respective support surfaces 16.1, 16.2 are arranged at an angle to one another. Support surfaces 16.1 are furthermore respectively incident at an angle to support surfaces 16.2, resulting in a frustoconical bit holder receptacle 16. Resetting spaces 16.3, 16.4, 16.5 in the form of recesses are provided respectively in the transition region between the individual support surfaces 16.1 and 16.2. A cutout 16.6 that creates a transition from bit holder receptacle 16 to threaded receptacle 18 is furthermore provided in the region of resetting space 16.5.

As is further evident from FIG. 2, a surface 17 that is demarcated laterally by oblique surfaces is formed around the entrance into threaded receptacle 18; the oblique surfaces open divergently toward the back side of base part 10. This creates a capability for easy cleaning of surface 17, and thus of a tool receptacle 43 of a compression screw 40. Compression screw 40 comprises a threaded segment 41 with which it can be screwed into threaded receptacle 18. Compression screw 40 is furthermore embodied with a compression extension 42 in the form of a frustoconical stem that is shaped integrally onto threaded segment 41.

As FIG. 2 further shows, bit holder 20 can be connected to base part 10. Bit holder 20 possesses a support member 21 that is equipped on the front side with a skirt 22. Skirt 22 carries an integrally shaped-on web 22.1 that rises upward proceeding from skirt 22. An extension 23 that terminates in a cylindrical segment 24 is also integrally coupled onto support member 21. Cylindrical segment 24 is provided with wear markings that are embodied in the present case as circumferential grooves 26. Cylindrical segment 24 terminates in a support surface 25 that concentrically surrounds the bore entrance of bit receptacle 27. Bit receptacle 27 transitions via a bevel-shaped introduction segment 27.1 into support surface 25.

Figure 4:
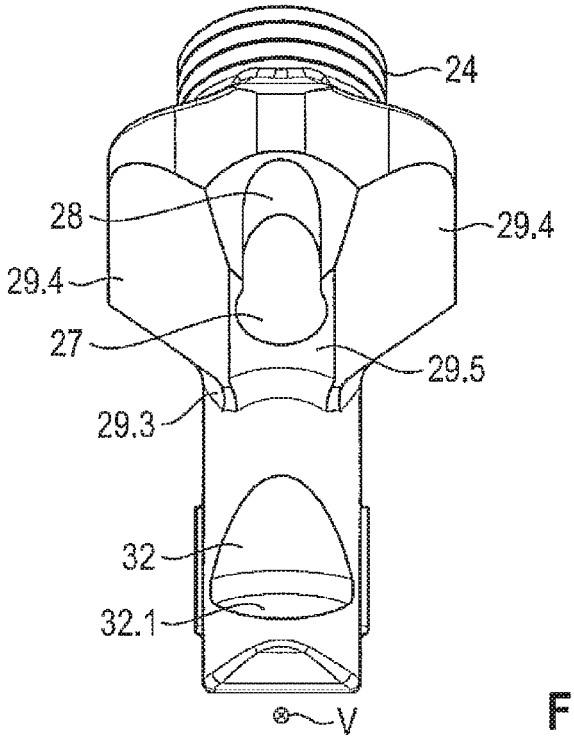
FIG. 4 is a rear view of the bit holder according to FIGS. 1 to 3.

As FIG. 4 shows, bit receptacle 27 is embodied as a passthrough bore. Support member 21 is provided with a back-side cutout that serves as a flushing conduit 28. Flushing conduit 28 consequently opens bit receptacle 27 radially outward in the region of its bore exit. Removed particles that have entered bit receptacle 27 during utilization of the tool can thus be conveyed radially outward through flushing conduit 28.

Figure 3:
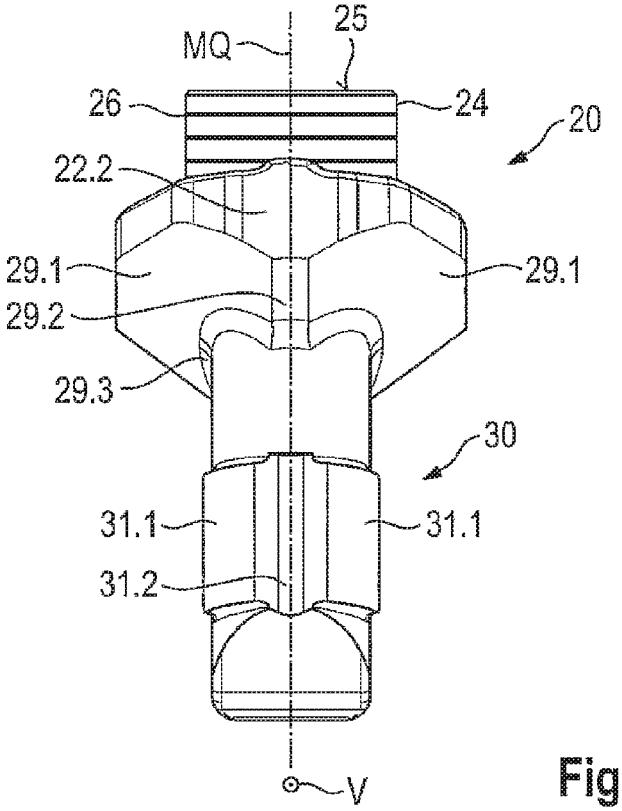
FIG. 3 is a front view of the bit holder according to FIGS. 1 and 2.

It is evident from FIG. 3 that support member 21 comprises first stripping surfaces 29.1 in the region of skirt 22. These stripping surfaces 29.1 are at an oblique angle $\epsilon_1$ to one another (see FIG. 13), and are connected to one another via a transition segment 29.2. The angle $\epsilon_1$ between first stripping surfaces 29.1 corresponds to the angle between first support surfaces 16.1 of base part 10.

It is evident from FIG. 4 that support member 21 possesses, on the back side, downward-pointing second stripping surfaces 29.4. Second stripping surfaces 29.4 are at an angle $\epsilon_2$ to one another (see FIG. 14); here as well, the angle $\epsilon_2$ between second stripping surfaces 29.4 corresponds to the angle between second support surfaces 16.2 of base part 10. While first stripping surfaces 29.1 transition into one another by means of transition segment 29.2, a transition region between the two stripping surfaces 29.4 is formed by flushing conduit 28 and a transition segment 29.5.

Stripping surfaces 29.1 and 29.4 each form stripping surface pairs in the shape of a prism. These prisms have a longitudinal center axis MLL that is formed in the angle bisector plane between the two first stripping surfaces 29.1 and second stripping surfaces 29.4, respectively. These angle bisector planes are labeled "WE" in FIGS. 13 and 14. The longitudinal center axis is indicated there as MLL; in principle, longitudinal center axis MLL can be located at any position within the angle bisector plane.

Figure 13:
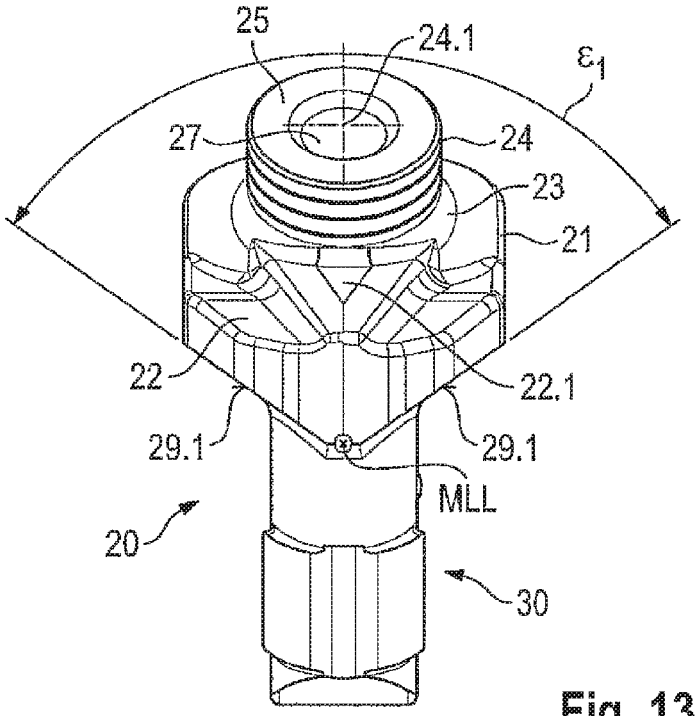
FIG. 13 is a view from the front of the bit holder according to FIG. 5.
Figure 14:
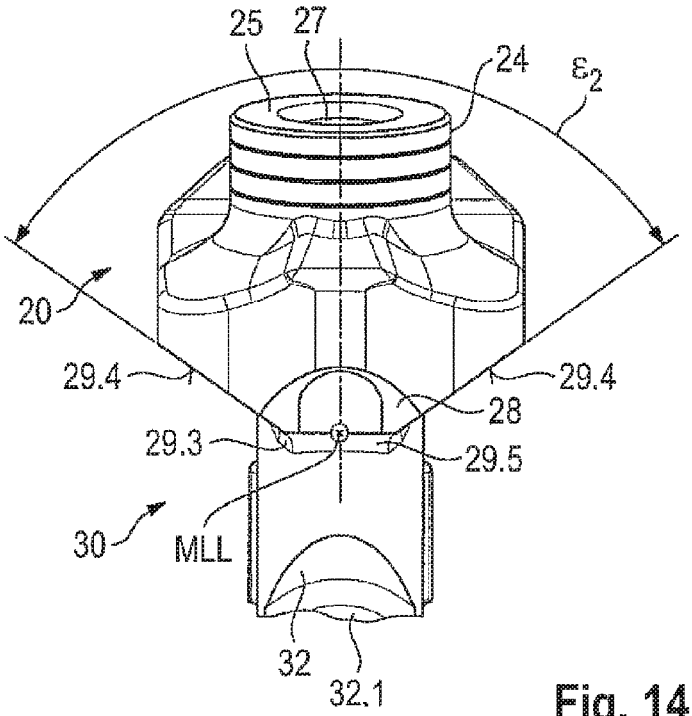
FIG. 14 is a view from behind of the bit holder.

FIGS. 3 and 4, in conjunction with FIGS. 13 and 14, show that first stripping surfaces 29.1 and also second stripping surfaces 29.4 diverge proceeding from the insertion projection side toward the working side. In the present example, the lines normal to stripping surfaces 29.1, 29.4 correspondingly converge from the insertion projection side toward the working side. The surface normal lines consequently converge in the region of the tool engagement point at which working forces are introduced into the tool system.

The use of two stripping surface pairs having the respective first and second stripping surfaces 29.1 and 29.4 takes optimally into account the variation in working forces during tool engagement. A comma-shaped chip is produced during tool engagement. Not only the force magnitude but also the force direction changes as this chip is formed. Correspondingly, at the beginning of tool engagement the working force acts in such a way that it is dissipated more via the stripping surface pair formed by first stripping surfaces 29.1. As tool engagement progresses, the direction of the working force rotates and it is then dissipated increasingly via the stripping surface pair formed by second stripping surfaces 29.4. The angle γ' (see FIG. 5) between the stripping surface pairs must therefore be embodied so that the variation in working force is taken into consideration, and so that this working force always acts into the prisms formed by the stripping surface pairs.

Figure 9:
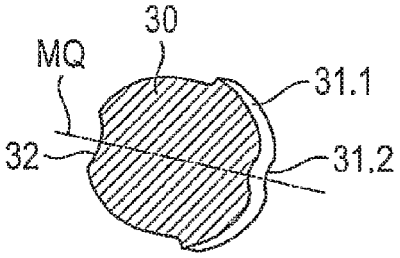
FIG. 9 shows a section marked IX-IX in FIG. 7.
Figure 10:
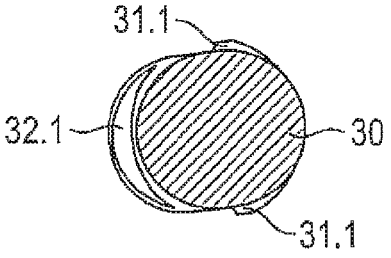
FIG. 10 shows a section marked X-X in FIG. 7.
Figure 11:
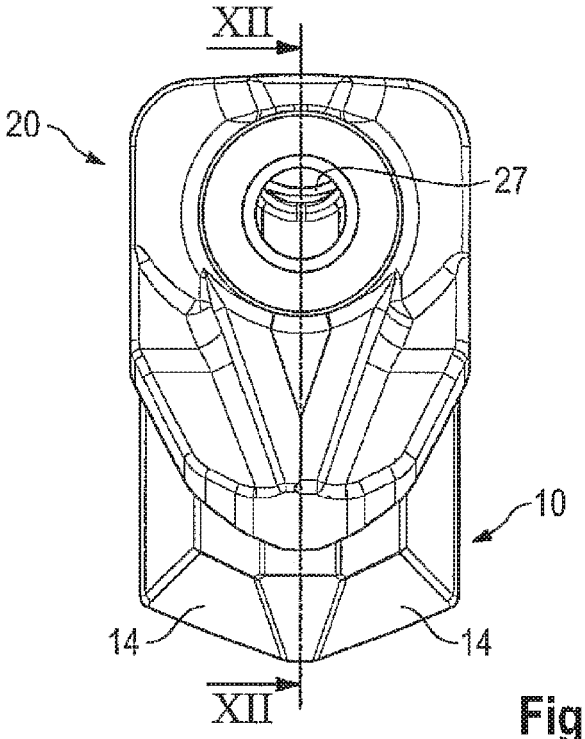
FIG. 11 is a plan view of the tool combination according to FIG. 1.

The central transverse plane MQ of bit holder 20 is labeled in FIGS. 3 and 9. The bit holder is constructed mirror-symmetrically with respect to this central transverse plane MQ, so that it can be installed on a milling drum as a right-hand or left-hand part.

The advance direction is characterized in FIGS. 3 and 4 with usual arrow indications. The bit holder sides are arranged transversely to the advance direction. The lines normal to stripping surfaces 29.1 and 29.4 thus each point downward and toward their side (viewed in the tool advance direction) of the bit holder, as is clear from FIGS. 3 and 4. This situation is shown again in FIG. 5 in a side depiction.

Figure 5:
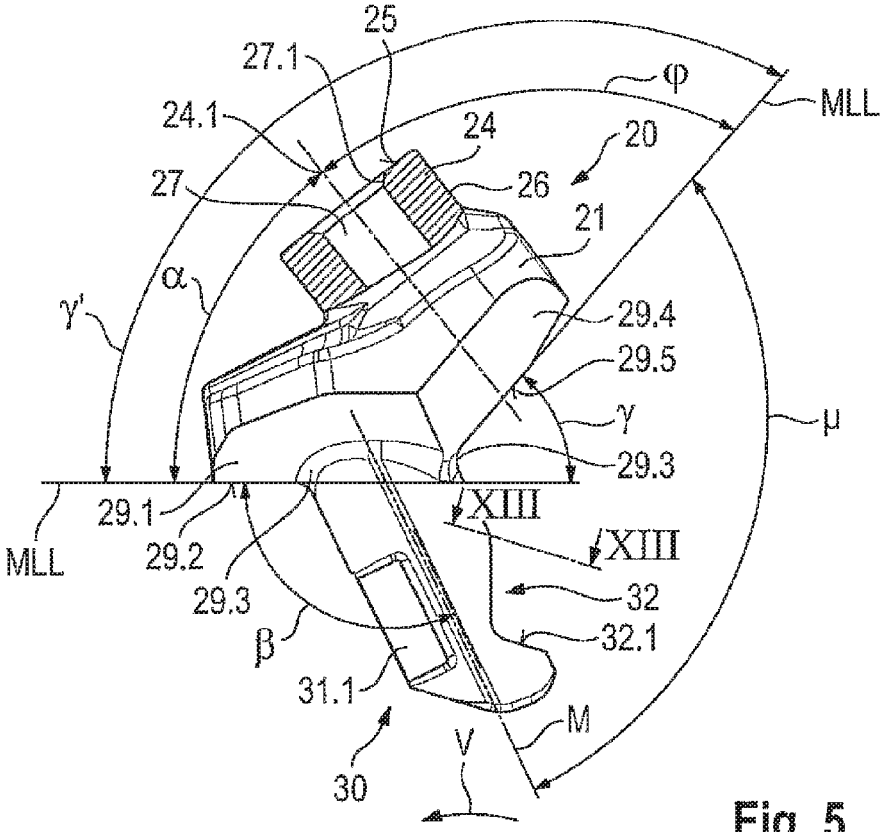
FIG. 5 is a side view from the left of the bit holder according to FIGS. 1 to 4.

The working force acts, however, not only in the direction of the image plane according to FIG. 5, but also in a transverse direction. These transverse force components are then ideally intercepted by the angled incidence ($\epsilon_1$, $\epsilon_2$) of stripping surfaces 29.1, 29.4. Because the working forces exhibit less variation in the transverse direction at the beginning of tool engagement, angle $\epsilon_1$ can also be selected to be smaller than $\epsilon_2$.

FIG. 5 further shows that an insertion projection 30 is shaped integrally onto support member 21 and transitions via a fillet transition 29.3 into first stripping surfaces 29.1 and second stripping surfaces 29.4. Insertion projection 30 is arranged so that it adjoins support member 21 substantially (at a proportion of approximately 90% in the present case) in the region of first stripping surfaces 29.1. Insertion projection 30 carries two abutment surfaces 31.1 on the front side. As is evident from FIG. 3, these are embodied as convexly curved cylindrical surfaces. Abutment surfaces 31.1 extend along and parallel to longitudinal center axis M (see FIG. 5) of insertion projection 30. Abutment surfaces 31.1 are thus also parallel to one another. Abutment surfaces 31.1 are arranged at a distance from one another in the circumferential direction of insertion projection 30. They have the same radius of curvature and are arranged on a common reference circle. The radius of curvature corresponds to half the reference circle diameter. A recess 31.2 is provided in the region between abutment surfaces 31.1, and abutment surfaces 31.1 extend parallel to recess 31.2. The recess can have a wide variety of shapes; for example, it can be simply a flat-milled surface. In the present exemplifying embodiment, recess 31.2 forms a hollow that is hollowed out in concave fashion between abutment surfaces 31.1. The concavity is designed so that a partly-cylindrically shaped geometry results. Recess 31.2 extends not over the entire length of insertion projection 30 but instead only over a sub-region, as is evident from FIG. 13. Recess 31.2 is open toward the free end of insertion projection 30, i.e. in the insertion direction. Recess 31.2 also opens up radially outward with no undercut. Insertion projection 30 comprises on the back side, located opposite abutment surfaces 31.1, a compression screw receptacle 32 that is equipped with a pressure surface 32.1.

Figure 6:
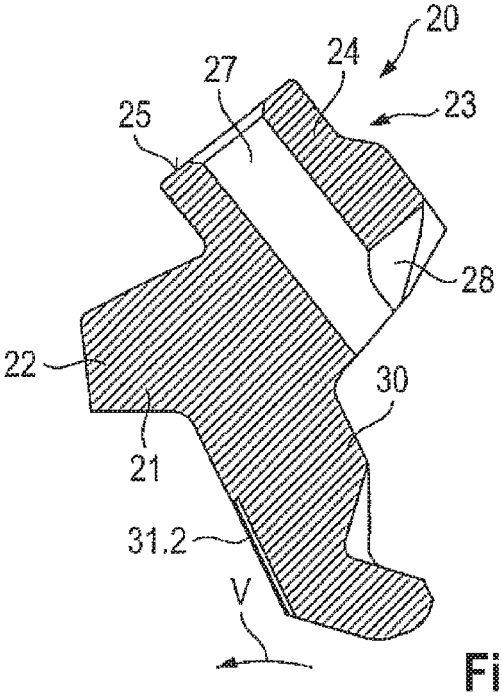
FIG. 6 is a vertical section, through the central transverse plane of the bit holder, of what is depicted in FIG. 5.

FIGS. 6 and 9 illustrate that recess 31.2 has a concavely inwardly curved geometry between the two abutment surfaces 31.1, and in particular can form a partly-cylindrically shaped cross section.

Figure 7:
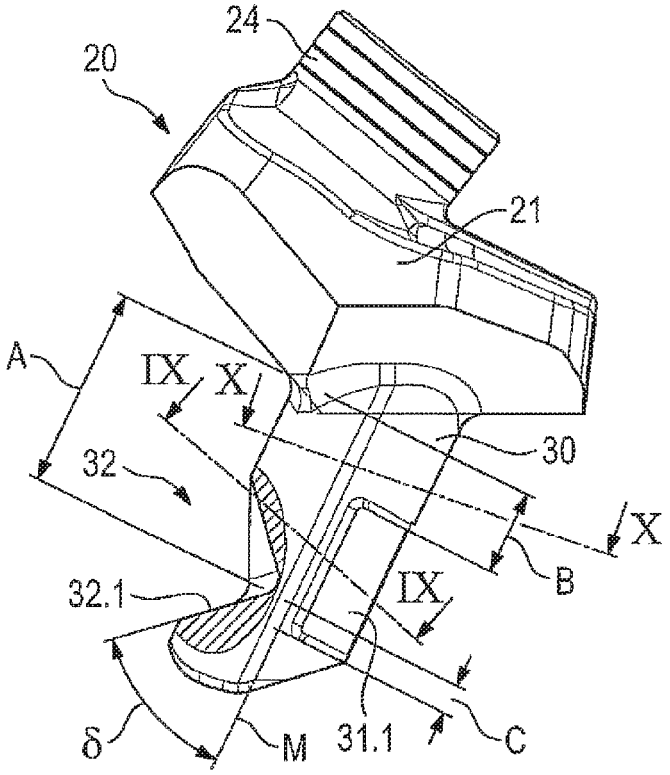
FIG. 7 is a side view from the right, partly in section, of the bit holder according to FIGS. 1 to 6.
Figure 8:
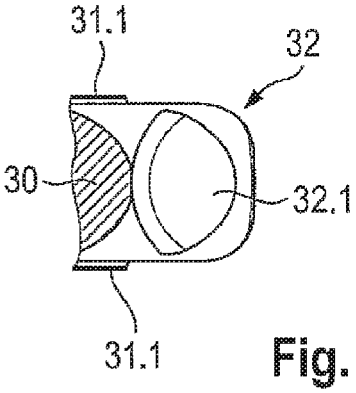
FIG. 8 shows a section marked VIII-VIII in FIG. 5.

FIGS. 7 to 10 depict in more detail the configuration of insertion projection 30. FIG. 9 clearly shows the concave inward curvature of recess 31.2 that adjoins the convex abutment surfaces 31.1. It is clear from FIG. 10 that insertion projection 30 has, in its region adjoining abutment surfaces 31.1, a substantially circular or oval cross-sectional conformation. FIG. 8 illustrates the region of compression screw receptacle 32, pressure surface 32.1 being incident at an angle δ to longitudinal center axis M of insertion projection 30. This angle of incidence δ is preferably in the range between 20° and 60° in order to achieve an optimum draw-in effect for bit holder 20.

FIG. 7 furthermore shows that pressure surface 32.1 is arranged at a distance equal to distance dimension A from the attachment region of insertion projection 30 onto support member 21.

Abutment surfaces 31.1 are arranged at a distance equal to distance dimension B from the attachment region of insertion projection 30 onto support member 21. The surface centroid of abutment surfaces 31.1 is arranged at a distance equal to distance dimension C from the surface centroid of pressure surface 32.1.

For installation of bit holder 20 into base part 10, insertion projection 30 is inserted into insertion receptacle 16.7. The insertion motion is limited by the first and second stripping surfaces 29.1, 29.4 that come to a stop against first and second support surfaces 16.1, 16.2.

Figure 12:
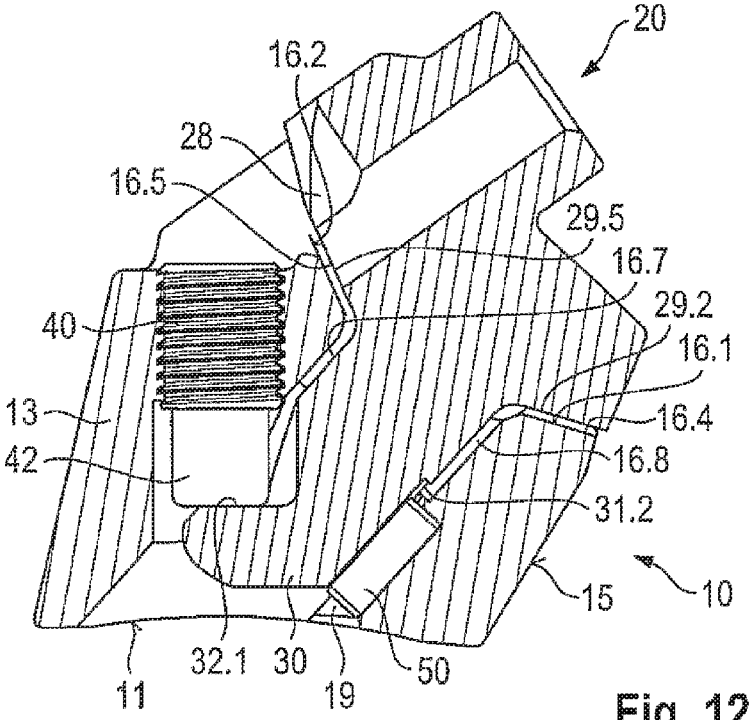
FIG. 12 shows a section marked XII-XII in FIG. 11.

As may be gathered from FIGS. 1 and 12, the correlation here is such that transition segment 29.2 extends beyond resetting space 16.4, resetting space 16.5 is spanned by transition segment 29.5, and the lateral resetting spaces 16.3 are spanned by the angled region that is formed between first and second stripping surfaces 29.1, 29.4. The result of the fact that bit holder 20 is distanced in the region of these resetting spaces 16.3, 16.4, 16.5 is that during working utilization, bit holder 20 can reset into resetting spaces 16.3, 16.4, 16.5 when stripping surfaces 29.1, 29.4 and/or support surfaces 16.1, 16.2 wear away. This is the case in particular when worn bit holders 20 are to be replaced with new ones, on an existing base part 10. To fix in place the installation state described above, compression screw 40 is screwed into threaded receptacle 18. Compression extension 42 thereby presses with its flat end surface onto pressure surface 32.1 and thus produces a draw-in force that acts in the direction of longitudinal center axis M of insertion projection 30. At the same time, however, compression screw 40 is incident at an angle to longitudinal center axis M of insertion projection 30 such that a clamping force acting toward the front side is also introduced into insertion projection 30. This clamping force is transferred via abutment surfaces 31.1 into the corresponding concave counter-surface of the cylindrical segment of insertion receptacle 16.7. The fact that abutment surfaces 31.1 are distanced via recess 31.2 guarantees that insertion projection 30 is reliably immobilized by way of the two bracing regions formed laterally by abutment surfaces 31.1. The result is, in particular, that the surface pressures which occur are also kept low as a result of the two abutment surfaces 31.1, leading to reliable immobilization of insertion projection 30.

Effective wear compensation can be implemented by the fact that bit holder 20 can reset into resetting spaces 16.3, 16.4, 16.5 in the event of wear; stripping surfaces 29.1, 29.4 extend beyond support surfaces 16.1, 16.2 at every point, so that in the event of erosion, support surfaces 16.1, 16.2 are in any case eroded uniformly without producing a "beard" or burr. This configuration is advantageous in particular when, as is usually required, base part 10 has a service life that extends over several life cycles of bit holders 20. Unworn bit holders 20 can then always be securely fastened and retained even on a base part 10 that is partly worn. It is thus also simple to repair a machine in which the tool system constituted by base part 10 and bit holder 20 is used. It is usual for a plurality of tool systems to be installed on such a machine, for example a road milling machine or surface miner, the base part usually being welded onto the surface of a tubular milling drum. When all or some of bit holders 20 are then worn, they can easily be replaced with new unworn or partly worn bit holders 20 (which can be used e.g. for rough clearing operations).

For replacement, firstly compression screw 40 is loosened. The worn bit holder 20 can then be pulled with its insertion projection 30 out of insertion receptacle 16.7 of base part 10, and removed. The new (or partly worn) bit holder 20 is then inserted with its insertion projection 30 into insertion receptacle 16.7 of base part 10. Compression screw 40 can then be replaced, if necessary, with a new one. It is then screwed into base part 10 and secured to bit holder 20 in the manner described.

It is evident from FIG. 12 that base part 10 carries a projection 50 that protrudes into insertion receptacle 16.7. This projection 50 is constituted in the present case by a cylindrical pin that is driven from attachment side 11 into a partly-cylindrical recess 19. Partly-cylindrical recess 19 surrounds the cylindrical pin over more than 180° of its circumference, so it is retained in lossproof fashion. That region of the cylindrical pin which protrudes into bit receptacle 27 engages into recess 31.2 between abutment surfaces 31.1. Upon insertion of insertion projection 30 into insertion receptacle 16.7, protrusion 50 threads reliably into recess 31.2 that is open toward the free end of insertion projection 30. Alignment of bit holder 20 with respect to base part 10 is thereby achieved. This alignment ensures that first and second stripping surfaces 29.1, 29.4 now come into accurately fitted abutment against support surfaces 16.1, 16.2 so that incorrect installation is precluded. In addition, the lock-and-key principle of projection 50, and of recess 31.2 adapted geometrically to it, prevents an incorrect bit holder 20 from inadvertently being installed on base part 10.

The angular correlations of bit holder 20 according to the present invention will be discussed in further detail below.

It is evident from FIG. 5 that longitudinal center axis 24.1 of bit receptacle 27 is at a respective angle $\alpha$ and $\phi$ to the longitudinal orientations of transition segments 29.2 and 29.5, and thus also to longitudinal center axis MLL of the prisms formed by first stripping surfaces 29.1 and by second stripping surfaces 29.4, respectively. The angle $\alpha$ can be between 40° and 60°, and the angle $\phi$ in the range between 70° and 90°.

FIG. 5 further shows that in a projection of stripping surfaces 29.1 and 29.4 into a plane perpendicular to the advance direction (said projection corresponding to FIG. 5), stripping surfaces 29.1 and 29.4 are angled with respect to one another at an angle $\gamma$ in the range between 40° and 60°, and that the opening angle between transition segments 29.2 and 29.5 in the longitudinal orientation according to FIG. 5 is between 120° and 140°. The angle $\gamma'$ between longitudinal center axes MLL of the two prisms formed by stripping surfaces 29.1 and 29.4 (stripping surface pairs) is correspondingly in the range between 120° and 140°. Furthermore, in a projection of this kind of stripping surfaces 29.1, 29.4, first stripping surfaces 29.1 are at an angle $\beta$, and second stripping surfaces at an angle $\mu$, to longitudinal center axis M of insertion projection 30. The same also applies here to longitudinal center axes MLL of the prisms. The angles $\beta$ and $\mu$ can be in the range between 100° and 130°, preferably in the range between 110° and 120°.

FIG. 13 shows that first stripping surfaces 29.1 enclose an angle $\epsilon_1$. This angle $\epsilon_1$ should preferably be in the range between 100° and 120°. The angle bisector of this angle $\epsilon_1$ is located in a plane, and FIG. 13 illustrates that insertion projection 30 is arranged symmetrically with respect to that plane.

In the same manner, the rear second stripping surfaces 29.4 are correspondingly also incident to one another at an angle $\epsilon_2$, as shown in FIG. 14. The angle $\epsilon_2$ can, however, differ from angle $\epsilon_1$, and in the present exemplifying embodiment can be between 120° and 140°, and insertion projection 30 is also arranged and equipped symmetrically with respect to the angle bisector plane of said angle $\epsilon_2$.

Figure 15:
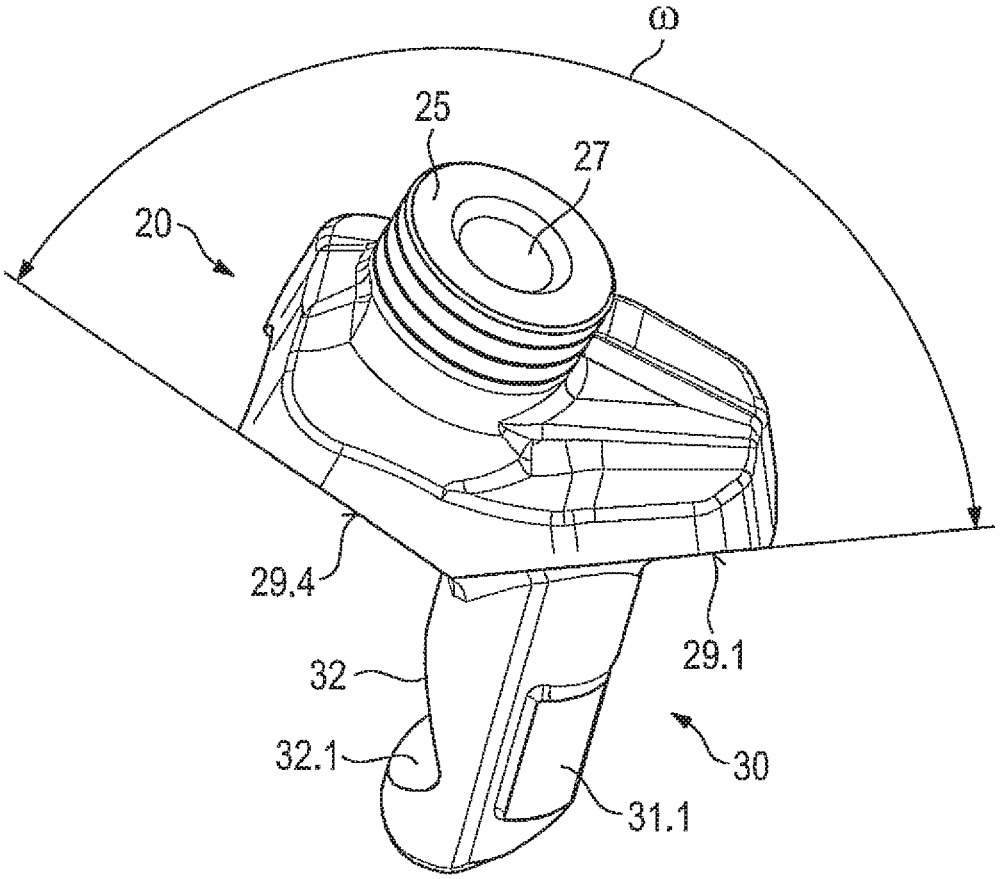
FIG. 15 is a rotated side view of the bit holder.

FIG. 15 shows that a first stripping surface 29.1 of the first stripping surface pair and a second stripping surface 29.4 of the second stripping surface pair are respectively incident to one another at an angle $\omega$, and form a support region.

The invention claimed is:

1. A tool system for an earth working machine, comprising:

a base part including an insertion receptacle defining a longitudinal insertion axis and including a threaded compression screw receptacle intersecting the insertion receptacle; and a tool apparatus including:

a support member having an insertion projection side and a working side, the working side facing away from the insertion projection side;

an insertion projection extending from the insertion projection side and received in the insertion receptacle of the base part, the insertion projection including at least two convex abutment surfaces circumferentially separated from one another and arranged forward of the longitudinal insertion axis with reference to a tool advance direction; and at least one pressure surface arranged rearward of the longitudinal insertion axis with reference to the tool advance direction and aligned with the threaded compression screw receptacle; and a compression screw received in the threaded compression screw receptacle and engaging the at least one pressure surface to force the abutment surfaces of the insertion projection into engagement with the insertion receptacle;

wherein the insertion receptacle of the base part and the insertion projection are configured such that the insertion projection is inserted into the insertion receptacle in a direction substantially parallel to the longitudinal insertion axis.

2. A tool system for an earth working machine, comprising:

a base part including an insertion receptacle defining a longitudinal insertion axis and including a threaded compression screw receptacle intersecting the insertion receptacle; and a tool apparatus including:

a support member having an insertion projection side and a working side, the working side facing away from the insertion projection side;

an insertion projection extending from the insertion projection side and received in the insertion receptacle of the base part, the insertion projection including at least two convex abutment surfaces circumferentially separated from one another and arranged forward of the longitudinal insertion axis with reference to a tool advance direction; and at least one pressure surface arranged rearward of the longitudinal insertion axis with reference to the tool advance direction and aligned with the threaded compression screw receptacle; and a compression screw received in the threaded compression screw receptacle and engaging the at least one pressure surface to force the abutment surfaces of the insertion projection into engagement with the insertion receptacle;

wherein the longitudinal insertion axis defines an insertion direction along which the insertion projection can be inserted into and removed from the insertion receptacle.

3. A tool system for an earth working machine, comprising:

a base part including an insertion receptacle defining a longitudinal insertion axis and including a threaded compression screw receptacle intersecting the insertion receptacle; and a tool apparatus including:

a support member having an insertion projection side and a working side, the working side facing away from the insertion projection side;

an insertion projection extending from the insertion projection side and received in the insertion receptacle of the base part, the longitudinal insertion axis defining an insertion direction along which the insertion projection can be inserted into and removed from the insertion receptacle, the insertion projection including at least two convex abutment surfaces arranged forward of the longitudinal insertion axis with reference to a tool advance direction; and at least one pressure surface arranged rearward of the longitudinal insertion axis with reference to the tool advance direction and aligned with the threaded compression screw receptacle; and a compression screw received in the threaded compression screw receptacle and engaging the at least one pressure surface to force the abutment surfaces of the insertion projection into engagement with the insertion receptacle.

4. The tool system of claim 3, wherein:

the at least two convex abutment surfaces extend parallel to the longitudinal insertion axis.

5. The tool system of claim 3, wherein:

the at least two convex abutment surfaces each have the same radius of curvature.

6. The tool system of claim 5, wherein:

the radius of curvature of the abutment surfaces is in a range of from 16 mm to 32 mm.

7. The tool system of claim 5, wherein:

the radius of curvature is constant over a length of the abutment surfaces.

8. The tool system of claim 3, wherein:

the at least two convex abutment surfaces each have the same curvature geometry.

9. The tool system of claim 3, wherein:

the at least two convex abutment surfaces each circumscribe an angle about the longitudinal insertion axis in a range of from 30° to 80°.

10. The tool system of claim 3, wherein:

the working side of the support member defines a bit longitudinal center axis;

the tool apparatus has a central plane including the longitudinal insertion axis of the insertion projection and including the bit longitudinal center axis; and the at least two abutment surfaces are arranged symmetrically with respect to the central plane.

11. The tool system of claim 3, wherein:

the working side of the support member defines a bit longitudinal center axis;

the tool apparatus has a central plane including the longitudinal insertion axis of the insertion projection and including the bit longitudinal center axis; and the at least one pressure surface is arranged symmetrically with respect to the central plane.

12. The tool system of claim 3, wherein:

the at least one pressure surface is spaced from the attachment of the insertion projection onto the support member by a distance of at least 20 mm.

13. The tool system of claim 3, wherein:

the abutment surfaces are spaced from the attachment of the insertion projection onto the support member by a distance of at least 15 mm.

14. The tool system of claim 3, wherein:

a surface centroid of at least one of the abutment surfaces is spaced from a surface centroid of the at least one pressure surface by a distance parallel to the longitudinal insertion axis of the insertion projection of no more than 20 mm.

15. The tool system of claim 3, wherein:

the longitudinal insertion axis of the insertion projection and a line normal to the at least one pressure surface and passing through a surface centroid of the at least one pressure surface, define a plane passing through the insertion projection between the at least two abutment surfaces.

16. The tool system of claim 3, wherein:

the abutment surfaces are defined on carrying segments elevated with respect to an outer surface of the insertion projection.

17. The tool system of claim 3, wherein:

a line normal to the at least one pressure surface is at an angle in a range of from 30° to 70° to the longitudinal insertion axis of the insertion projection.

18. The tool system of claim 3, wherein:

the working side of the support member includes a bit receptacle defining a bit longitudinal center axis.

* * * * *